US010533541B1

(12) United States Patent
Bonny

(10) Patent No.: US 10,533,541 B1
(45) **Date of Patent: *Jan. 14, 2020**

(54) HYDRAULIC RUNNING SURFACE

(71) Applicant: Hydro-Gear Limited Partnership, Sullivan, IL (US)

(72) Inventor: Nathan W. Bonny, Shelbyville, IL (US)

(73) Assignee: Hydro-Gear Limited Partnership, Sullivan, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/026,634

(22) Filed: Jul. 3, 2018

Related U.S. Application Data

(63) Continuation of application No. 15/600,353, filed on May 19, 2017, now Pat. No. 10,018,190, which is a continuation of application No. 14/248,570, filed on Apr. 9, 2014, now Pat. No. 9,657,726.

(60) Provisional application No. 61/813,972, filed on Apr. 19, 2013.

(51) Int. Cl.
*F04B 1/20* (2006.01)

(52) U.S. Cl.
CPC ..... *F04B 1/2021* (2013.01); *F04B 1/2078* (2013.01)

(58) Field of Classification Search
CPC .. F04B 1/2021; F04B 1/2078; F04B 27/0826; F04B 27/086
See application file for complete search history.

(56) References Cited

U.S. PATENT DOCUMENTS

| | | | | |
|---|---|---|---|---|
| 3,585,901 | A * | 6/1971 | Moon, Jr. | F04B 1/2021 417/312 |
| 5,564,905 | A * | 10/1996 | Manring | F04B 1/2021 417/222.1 |
| 5,807,080 | A * | 9/1998 | Ochiai | F04B 1/2021 417/269 |
| 6,640,687 | B1 | 11/2003 | Frantz et al. | |
| 6,997,099 | B1 * | 2/2006 | Trimble | F04B 1/2021 91/503 |
| 9,657,723 | B1 * | 5/2017 | Iyer | F03G 6/06 |
| 10,018,190 | B1 * | 7/2018 | Bonny | F04B 27/0826 |

* cited by examiner

*Primary Examiner* — Charles G Freay
(74) *Attorney, Agent, or Firm* — Neal, Gerber & Eisenberg LLP

(57) ABSTRACT

A hydraulic drive device includes a running surface having a pair of arcuate kidney ports formed thereon. The running surface also includes a plurality of pressure gradient grooves formed on the running surface, each pressure gradient groove having a proximal end adjacent to a respective one of the ends of one of the kidney ports and a distal end. The distal end of one of the pressure gradient grooves associated with one kidney port may overlap the distal end of a pressure gradient groove associated with the other kidney port. The distal end of at least one of the pressure gradient grooves is located outside the circumference of a pitch circle that passes through the center of each kidney port. The distal end of at least one of the other pressure gradient grooves is located inside the pitch circle circumference.

19 Claims, 10 Drawing Sheets

HYDRAULIC RUNNING SURFACE

CROSS-REFERENCE

This application is a continuation of U.S. patent application Ser. No. 15/600,353, filed on May 19, 2017, which is a continuation of U.S. patent application Ser. No. 14/248,570, filed on Apr. 9, 2014, now U.S. Pat. No. 9,657,726, which claims the benefit of U.S. Provisional Patent Application No. 61/813,972, filed on Apr. 19, 2013. The contents of these prior applications are fully incorporated herein by reference.

BACKGROUND OF THE INVENTION

This invention relates generally to a running surface on which a hydraulic rotating kit such as a hydraulic pump cylinder block is rotatably mounted.

SUMMARY OF THE INVENTION

An improved running surface having pressure gradient grooves adjacent to the respective kidney ports is disclosed herein. In one aspect of this disclosure, at least one of the pressure gradient grooves has a distal end located outside of the pitch circle formed by the kidney ports and at least one of the pressure gradient grooves has a distal end located inside the circumference of the pitch circle. In another aspect of this disclosure, the distal ends of opposing pressure gradient grooves overlap each other. In the embodiments depicted herein, the two pressure gradient grooves with their distal ends disposed outside this circumference correspond to the trailing end of the respective kidney ports, while the other two pressure gradient grooves correspond to the leading end of their respective kidney ports. This design results in improved pressure and flow pulsations in the unit and reduced noise. The disclosure herein may be used in connection with pump end caps, center sections and other mounting structure for one or more rotating kits used in a hydraulic drive device or other application, and may be used with or without a separate valve plate.

A better understanding of the objects, advantages, features, properties and relationships of the invention will be obtained from the following detailed description and accompanying drawings which set forth illustrative embodiments that are indicative of the various ways in which the principles of the invention may be employed.

DETAILED DESCRIPTION OF THE DRAWINGS

Figure 1:
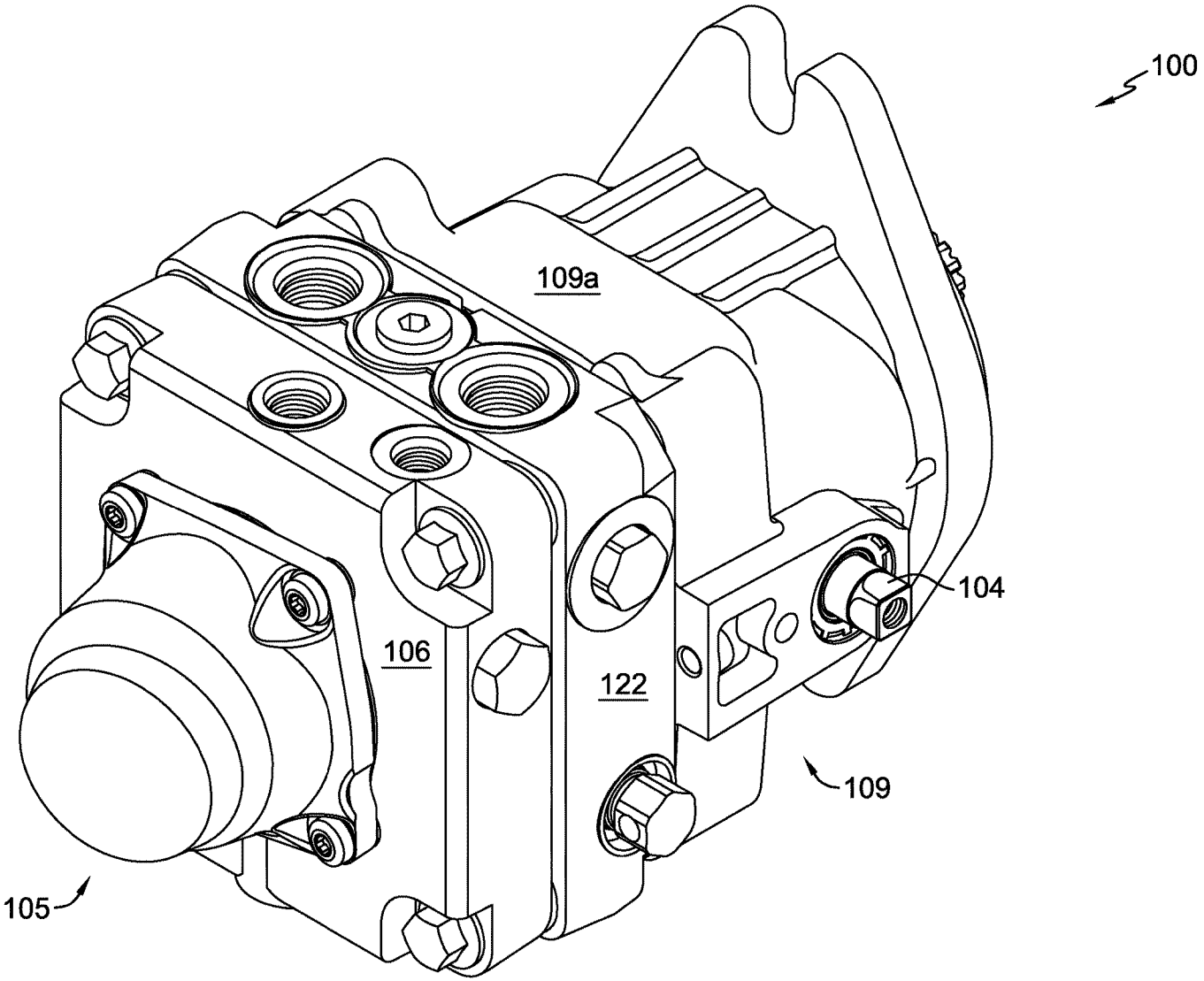
FIG. 1 is a perspective view of an exemplary pump assembly using an end cap incorporating teachings of the present invention.

The description that follows describes, illustrates and exemplifies one or more embodiments of the invention in accordance with its principles. This description is not provided to limit the invention to the embodiment(s) described herein, but rather to explain and teach the principles of the invention in order to enable one of ordinary skill in the art to understand these principles and, with that understanding, be able to apply them to practice not only the embodiment(s) described herein, but also any other embodiment that may come to mind in accordance with these principles. The scope of the invention is intended to cover all such embodiments that may fall within the scope of the appended claims, either literally or under the doctrine of equivalents.

It should be noted that in the description and drawings, like or substantially similar elements may be labeled with the same reference numerals. However, sometimes these elements may be labeled with differing numbers or serial numbers in cases where such labeling facilitates a more clear description. Additionally, the drawings set forth herein are not necessarily drawn to scale, and in some instances proportions may have been exaggerated to more clearly depict certain features. As stated above, this specification is intended to be taken as a whole and interpreted in accordance with the principles of the invention as taught herein and understood by one of ordinary skill in the art.

Figure 9:
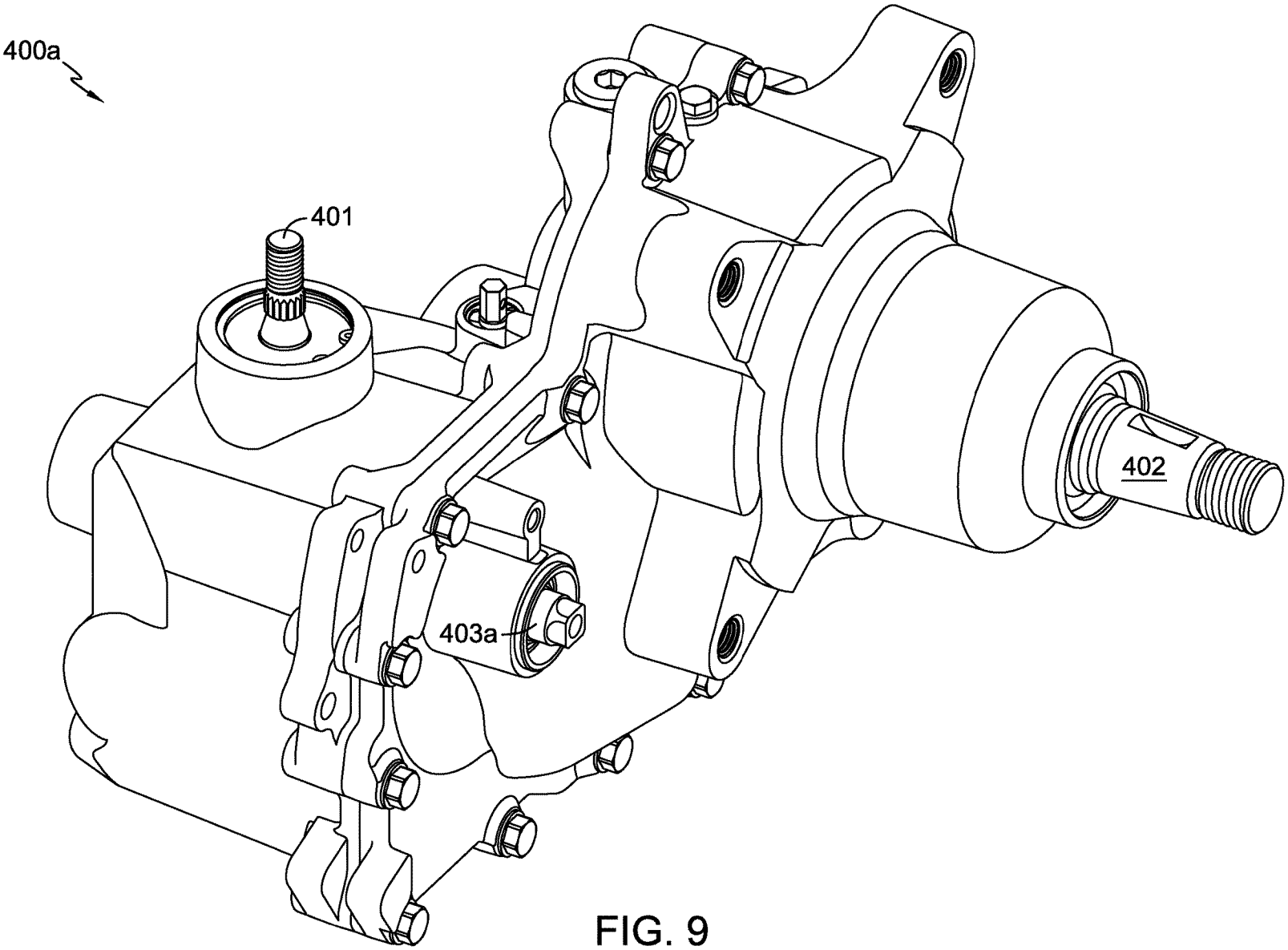
FIG. 9 is a perspective, external view of an exemplary transaxle which may incorporate a running surface in accordance with one or more teachings disclosed herein.
Figure 10:
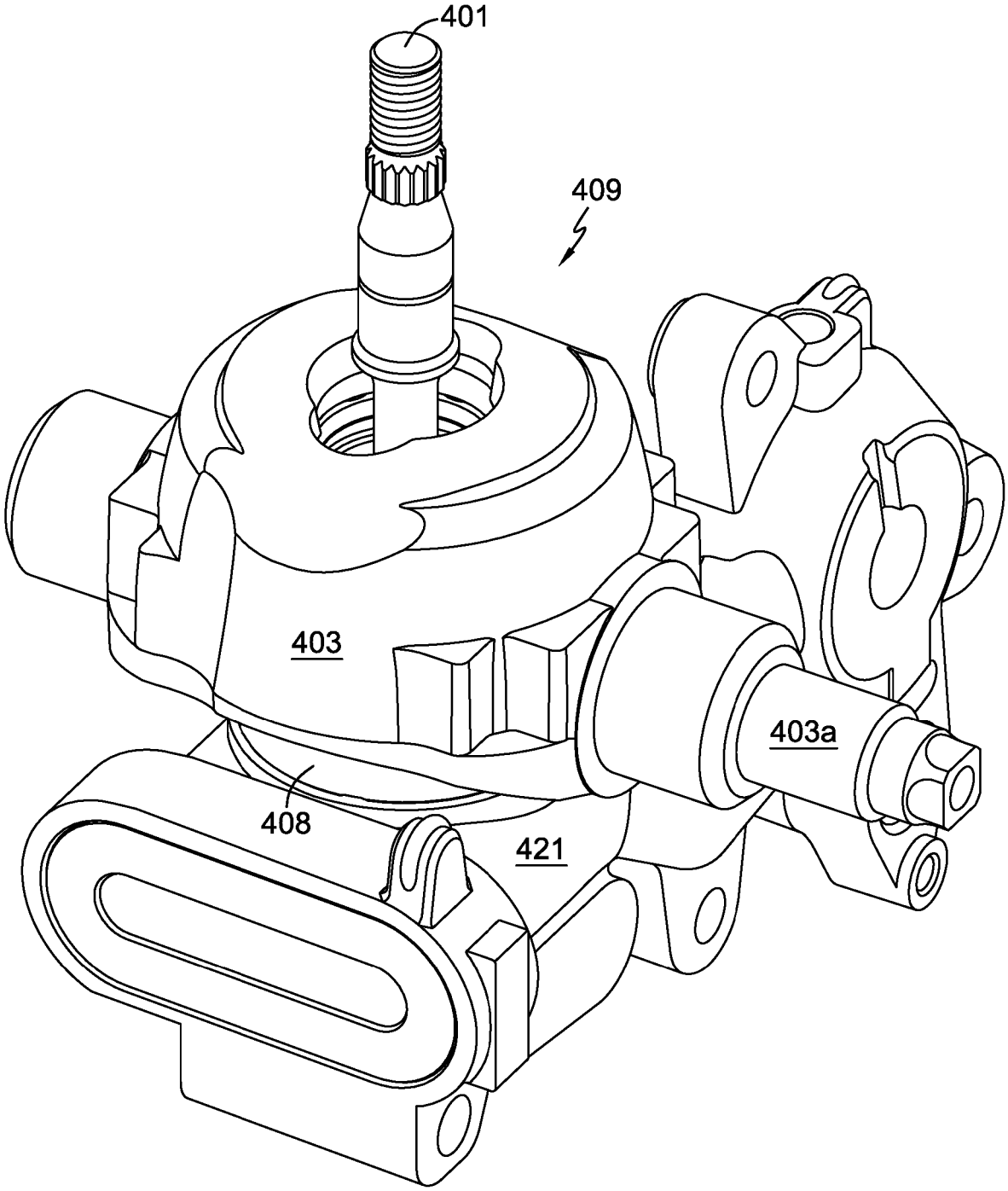
FIG. 10 is a perspective view of certain components of an exemplary hydraulic drive assembly which may be used in the transaxle of FIG. 9.
Figure 11:
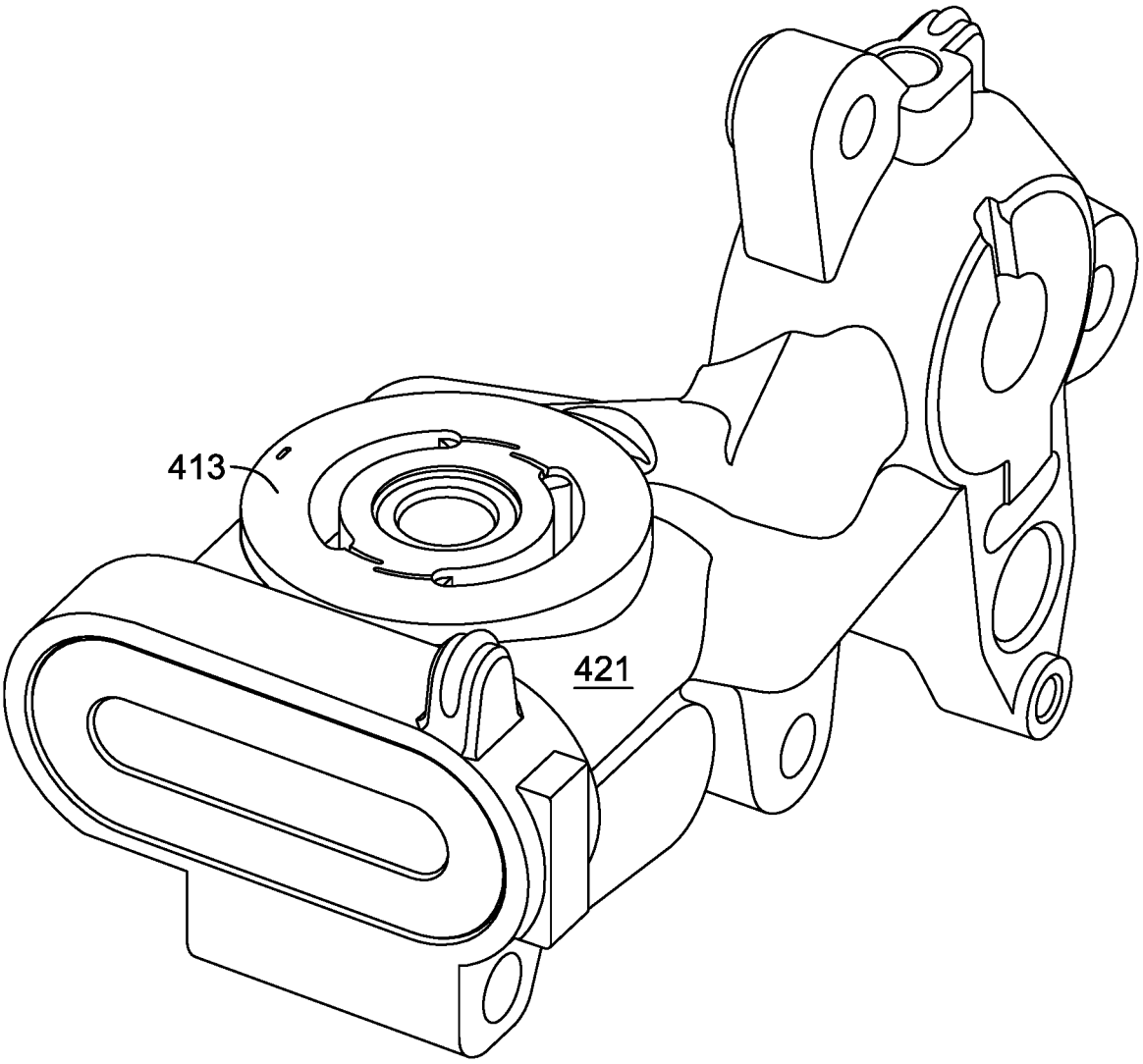
FIG. 11 is a perspective view of the center section depicted in FIG. 10, showing the running surface thereof.
Figure 12:
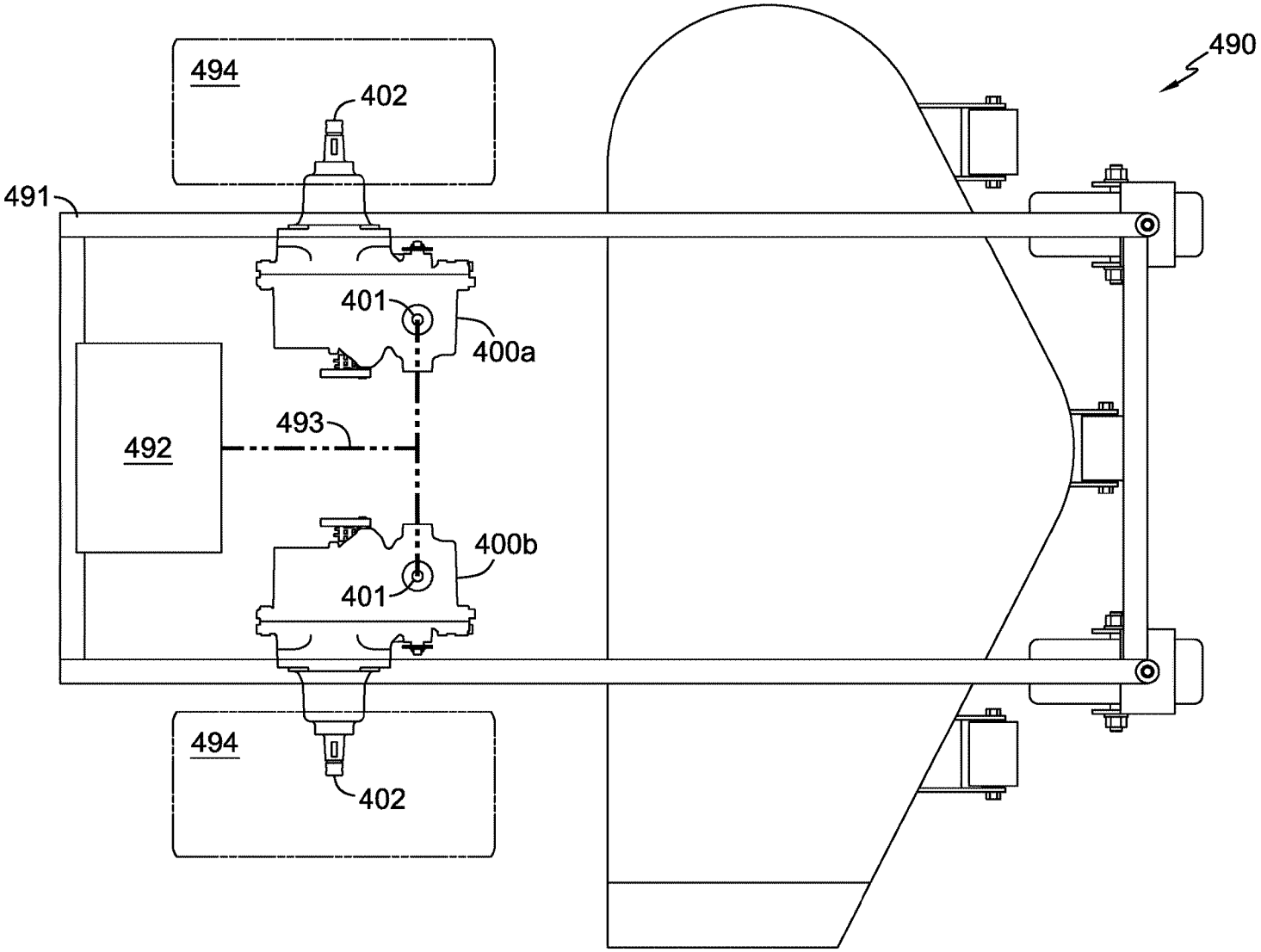
FIG. 12 is a plan view of an exemplary vehicle incorporating the transaxle of FIG. 9.

An exemplary pump assembly 100 is shown in FIG. 1, where a main pump 109 includes an end cap 122 disposed between main pump housing 109*a* and a separate end cap 106 for an auxiliary pump 105. A trunnion arm 104 extends out of housing 109*a* and is used to control the displacement of the hydraulic pump (not shown) located in main pump housing 109*a*. A transaxle that can also use the teachings of this invention is depicted in FIGS. 9-11, which disclose a hydraulic pump 409 including a pump shaft 401 driving a cylinder block 408, which is disposed on a running surface 413 located on center section 421. A swash plate 403 is controlled by trunnion arm 403*a*. FIG. 12 depicts an exemplary vehicle 490 having transaxles 400*a*, 400*b* mounted on a frame 491, where output axles 402 drive a pair of wheels 494 for zero turn operation. Transaxles 400*a*, 400*b* are driven by prime mover 492 through a belt and pulley assembly 493. The pump assembly 100 and end caps 122 are similar in many respects to those disclosed in commonly owned U.S. Pat. No. 9,074,670 and commonly owned U.S. Pat. No. 6,332,393, and the transaxle 400*a* is similar in many respects to that disclosed in commonly owned U.S. Pat. No. 9,341,258. The disclosures of these patents, which are incorporated by reference herein in their entirety, also teach other elements of hydraulic pump assemblies and transaxles that may be relevant to this disclosure.

Turning first to the embodiment shown in FIGS. 2-5, end cap 122 has a running surface 113 with a pair of arcuate kidney ports 118 and 119 formed thereon to communicate with hydraulic porting 120 internal thereto, which is understood to constitute various internal passages. In general, kidney ports 118 and 119 are symmetrically disposed about the centerline 112 of running surface 113, as indicated by the reflective angles 'B' which are preferably in the range of 22 to 24 degrees. A rotating pump cylinder block, such as cylinder block 408, may be disposed on running surface 113, and a pump or input shaft, such as input shaft 401, would extend through the pump and shaft support bore 111 formed in end cap 122. As is known in the art, system ports 126 and 127 may be formed in one side of end cap 122 to permit the pump and hydraulic porting 120 to communicate with other parts of a hydraulic system such as, for example, a hydraulic motor (not shown). A diagnostic port 128 is also depicted between system ports 126 and 127, and end cap 122 may optionally include stiffening ribs 117 to ensure flatness of running surface 113 under load. It will be understood that end cap 122 includes other ports such as a bypass port, inlet port, etc., none of which are specifically shown but which may be formed on other sides of end cap 122.

Figure 2:
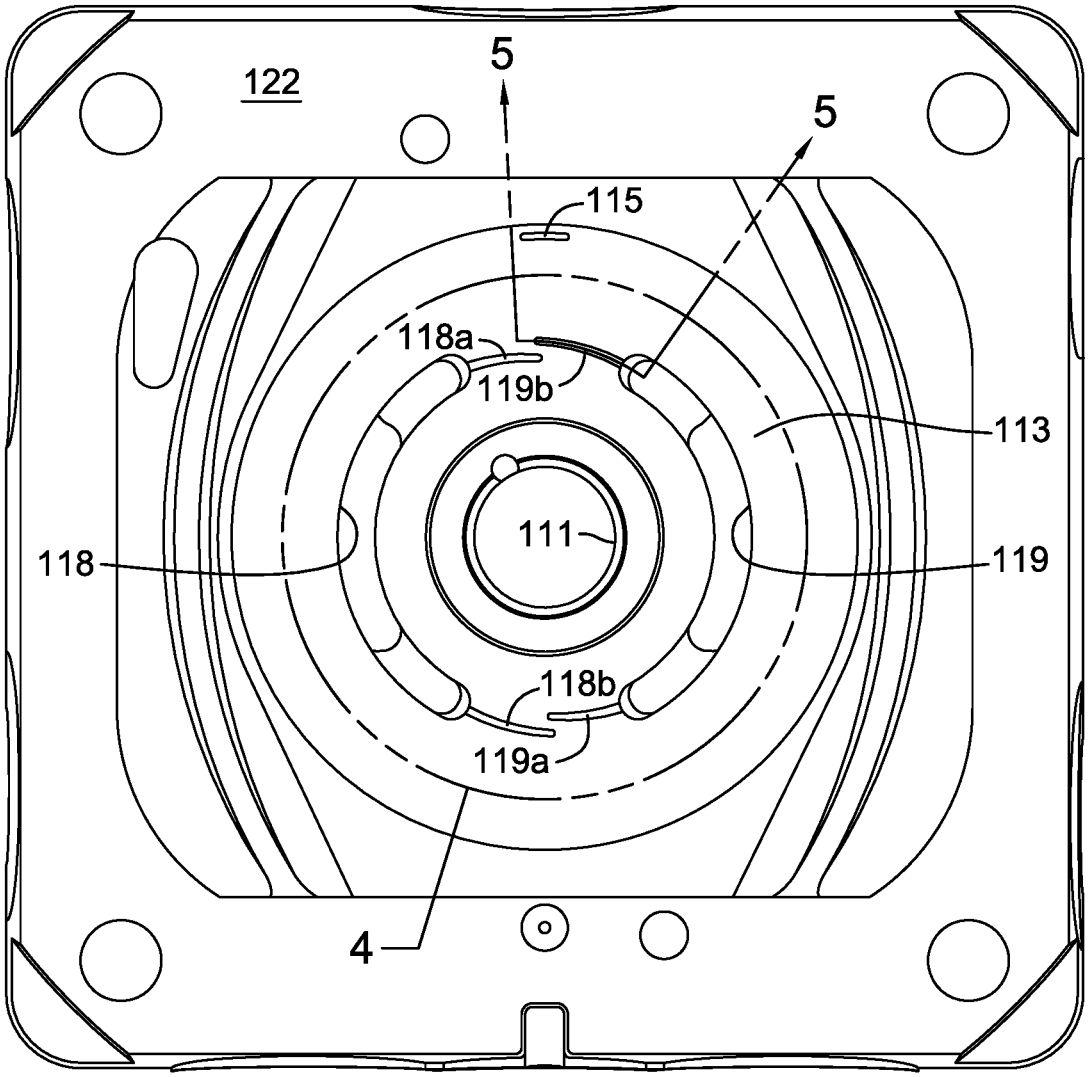
FIG. 2 is a plan view of an end cap for a hydraulic drive unit such as the pump assembly shown in FIG. 1 and having a running surface in accordance with one or more of the principles disclosed herein.
Figure 3:
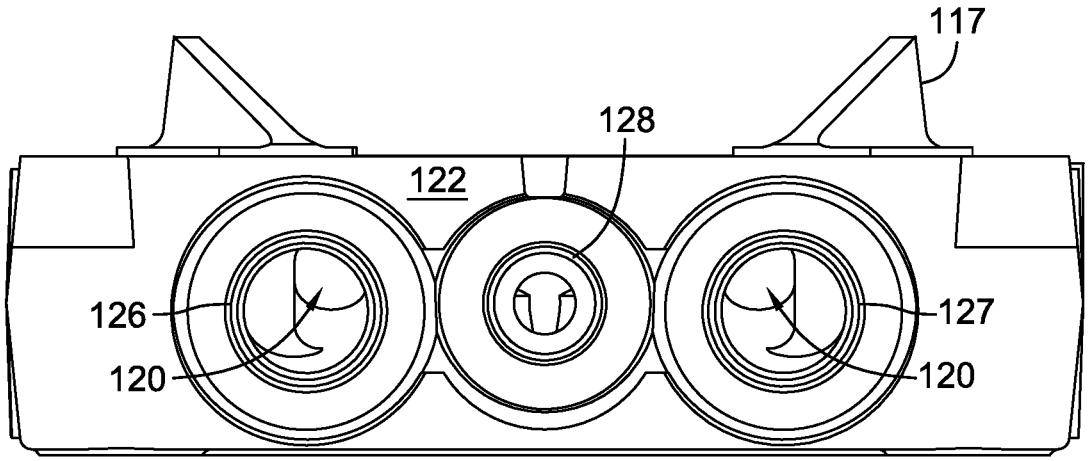
FIG. 3 is a side elevational view of the end cap of FIG. 2.
Figure 4:
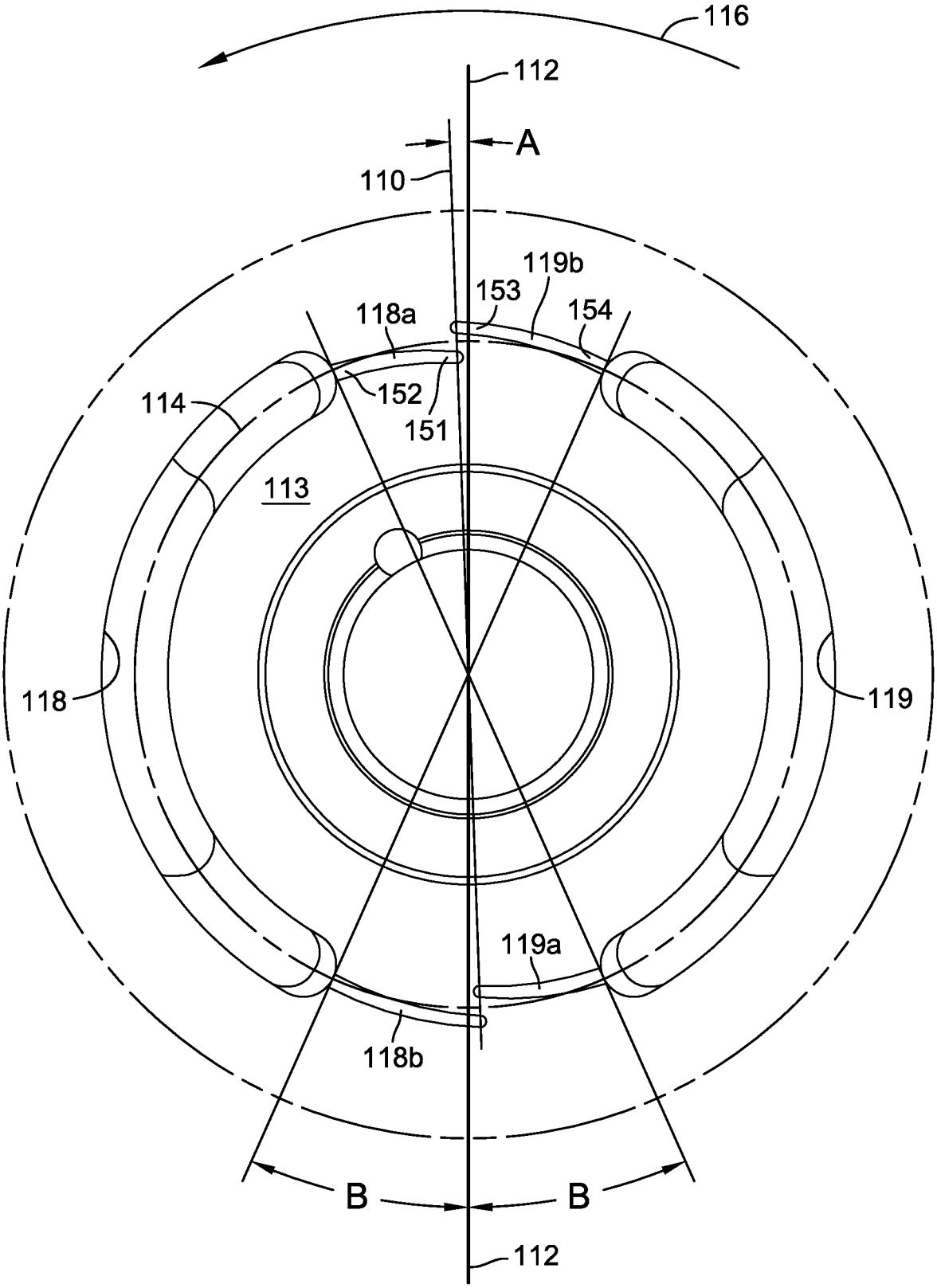
FIG. 4 is a plan view of a portion of the running surface of the end cap shown in FIG. 2.

The terms "rat tail" or "fishtail" are often used to describe a pressure gradient groove formed on a running surface adjacent the end of a kidney port, such as the pressure gradient grooves 118*a*, 118*b*, 119*a* and 119*b* shown in FIG. 2. In this application, the terms "pressure gradient groove" or "groove" will generally be used to describe these features. The term "pitch circle" is used to describe the circle 114 that runs generally through the center of each of the kidney ports 118, 119 and aligns with the rotational path the pump cylinders in the cylinder block (not shown) traverse. This term is not used in the mathematical sense but should be understood to incorporate ordinary engineering and machining tolerances. The term "kidney port" is also used broadly to describe the ports on a running surface for a rotating cylinder block to permit fluid communication between the cylinder block and a hydraulic porting system.

Each kidney port 118 and 119 has two opposing ends, and a groove formed at each end. Grooves 118*a* and 118*b* extend from opposing ends of kidney port 118 while grooves 119*a* and 119*b* extend from opposing ends of kidney port 119. As can be seen most clearly in FIG. 4, groove 119*b* has a proximal end 154 adjacent one end of kidney port 119 and distal end 153 which is disposed outside the circumference of pitch circle 114. Groove 118*a* has a proximal end 152 adjacent one end of kidney port 118 and distal end 151 which is disposed inside the circumference of pitch circle 114. It can be further seen that while distal end 151 approaches centerline 112, distal end 153 passes over the centerline 112 such that the radial centers of distal ends 151 and 153 lie on a line 110 that is radially offset from centerline 112, forming an angle 'A' therewith, which is preferably 2 degrees. This arrangement permits an overlap between the distal ends 151 and 153 of grooves 118*a* and 119*b*, to permit communication between these two grooves during operation. The same arrangement is preferably used with grooves 119*a* and 118*b* formed at the other ends of respective kidney ports 119 and 118. Such overlap and the resulting communication between the two pressure sides improves the ability of the unit to find and maintain neutral under no load conditions. It will be understood, however, that the relationship of the various distal ends of the grooves with respect to one another may be varied within the principles and scope of this disclosure. For example, the overlap of distal ends 151 and 153 could be greater than that depicted in FIG. 4, such that the radial centers of these distal ends are no longer on line 110. In the embodiment shown, the rotation of the pump cylinder block is counterclockwise, as depicted by reference arrow 116, so that grooves 118*b* and 119*b* are the trailing grooves, while grooves 118*a* and 119*a*, inside the circumference of the pitch circle, are leading. It will be understood that the design could be mirrored for clockwise rotation if preferred.

Figure 5:
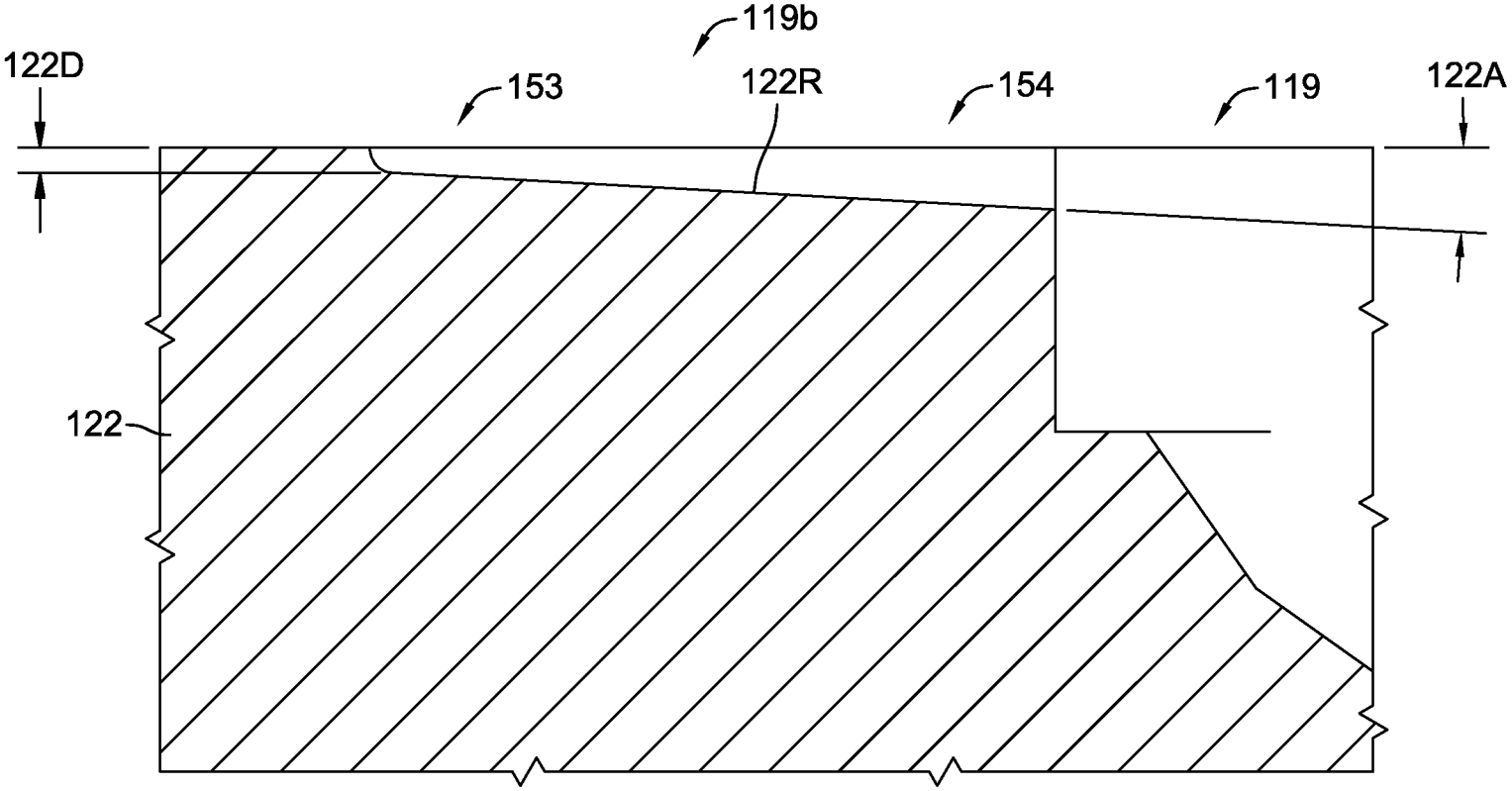
FIG. 5 is a cross-sectional view along the line 5-5 of FIG. 2.

The depth of each groove 118*a* and 119*b* varies from one end to the other, being deeper at the proximal end 152, 154 adjacent the end of the respective kidney port and shallower at the distal end 151, 153. It will be understood that the other grooves 118*b* and 119*a* would be identical to their corresponding groove. These grooves have a generally flat ramp 122R as shown in the cross-sectional view of groove 119*b* in FIG. 5. Ramp 122R extends at a constant ramp angle 122A from the initial depth 122D, preferably 0.016 in. for each groove. In grooves 119*b* and 118*b*, ramp angle is preferably 3 degrees, while in grooves 118*a* and 119*a* the preferred ramp angle is 7 degrees. The terminus of groove 119*b* adjacent proximal end 154 is depicted in FIG. 5 as a vertical drop into kidney port 119, but it will be understood that this portion (and the equivalent portion of the other grooves) could also be radiused if desired.

FIG. 2 also depicts a separate reference groove 115 that is not functional during operation of the apparatus but is used to ensure that the existing grooves are machined to the proper depth and profile. This optional reference groove is machined as a flat or constant depth groove, rather than a ramped groove, using the same tool that forms grooves 118*a*, 118*b*, 119*a*, and 119*b*, and is preferably machined to a depth of 0.016 in. This eliminates the need to artificially flatten a portion of the ramped grooves to create a specific location for gauging tool performance. Eliminating this flattened portion of the ramped grooves further reduces flow and pressure pulsations as cylinder pistons transition between kidney ports 118 and 119. It should be understood that the specific location of reference groove 115 may be varied.

Figure 8:
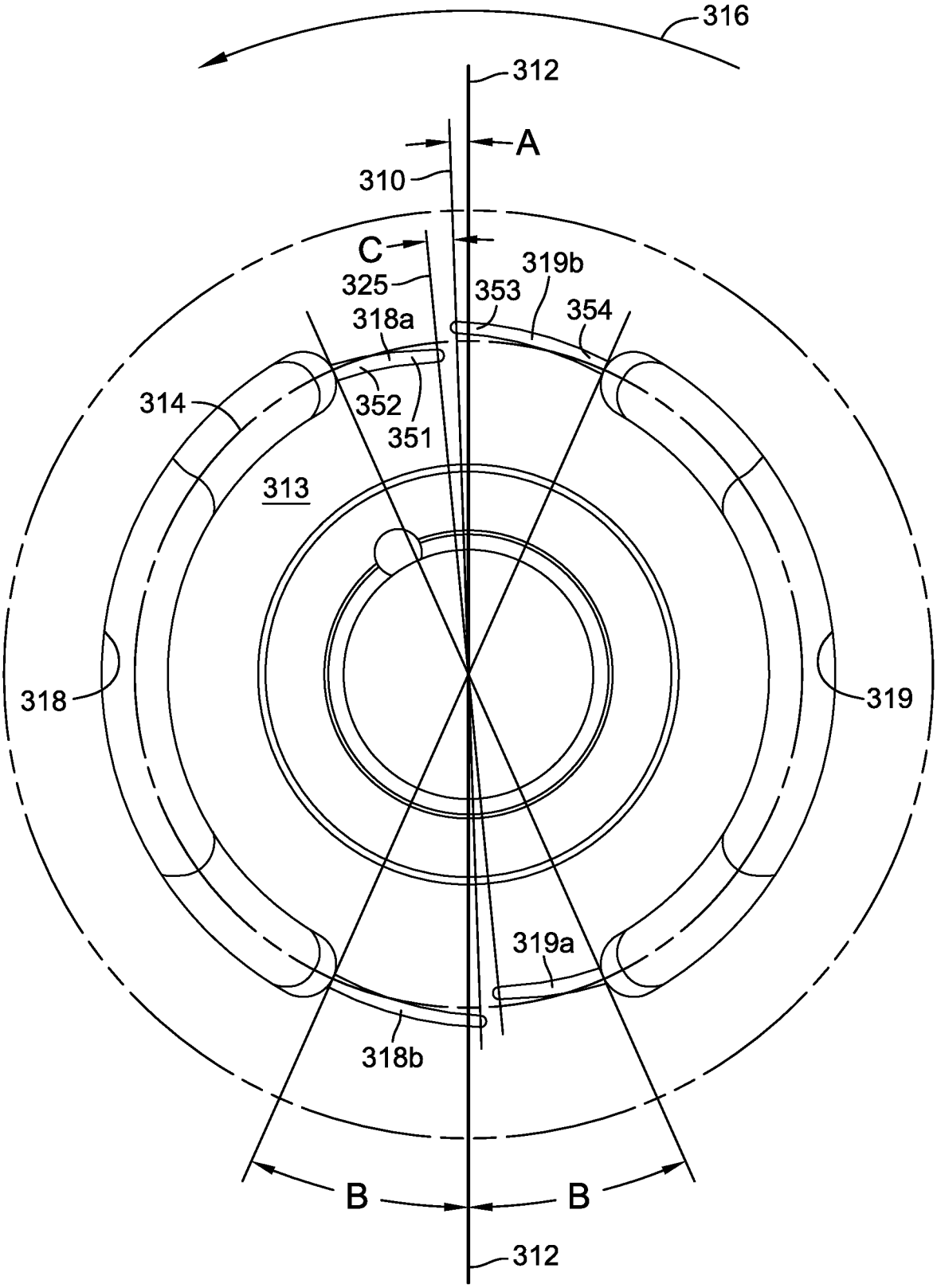
FIG. 8 is a plan view of a portion of a running surface for a second embodiment of the invention.

A further embodiment is depicted in FIG. 8, depicting running surface 313 where grooves 318*a*, 318*b*, 319*a* and 319*b* are similar in many respects to those previously disclosed. As shown by reference arrow 316, this embodiment is intended for counterclockwise rotation of the cylinder block. The distal ends 351 and 353 of the respective grooves are offset from pitch circle 314, but do not overlap. Specifically, groove 318*a* has a proximal end 352 adjacent one end of kidney port 318 and distal end 351 which is disposed inside the circumference of pitch circle 314. Distal end 353 passes over the centerline 312 such that the radial center of distal end 353 lies on a line 310 with the radial center of the corresponding trailing groove 318*b*. Line 310 is radially offset from centerline 312, forming an angle 'A' therewith, which is preferably 2 degrees. The radial center of distal end 351 of groove 318*a* is further offset from centerline 312, and lies on a line 325 with the radial center of the distal end of corresponding leading groove 319*a*, with line 325 forming an angle 'C' with line 310, with the angle 'C' being preferably from one to three degrees. It will be understood that the values of the angles 'A,' 'B,' and 'C' can be varied depending on the size of the rotating kits being used and the desired performance characteristics. For example, a larger value for the 'C' angle corresponds to a more aggressive response, but correspondingly increased noise. It has also been determined that the overlap design shown in, e.g., FIG. 2 provides a smoother response to user inputs to the transmission, whereas the "gap" design of FIG. 8 provides a more aggressive response to such inputs.

Figure 7:
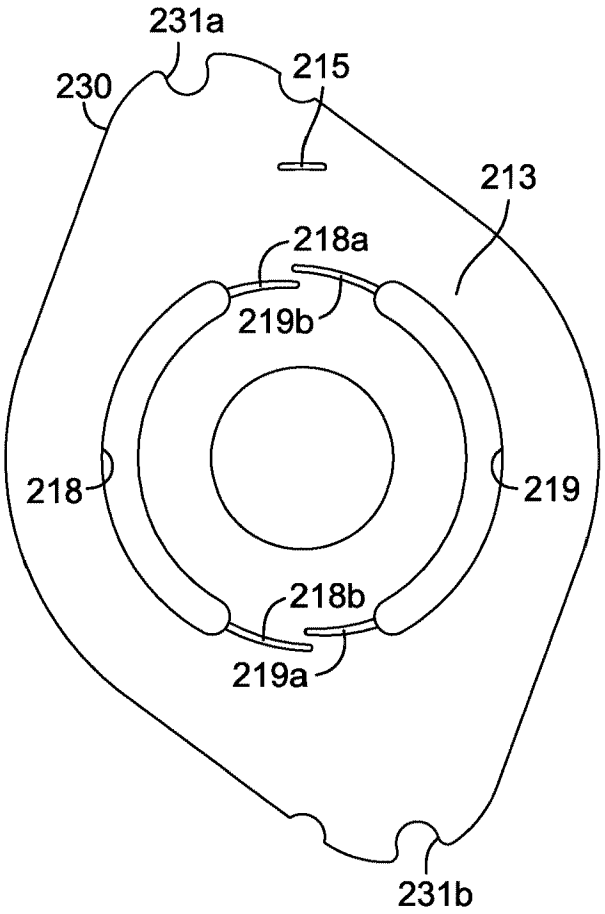
FIG. 7 is a plan view of the valve plate to be applied to the end cap of FIG. 6.
Figure 6:
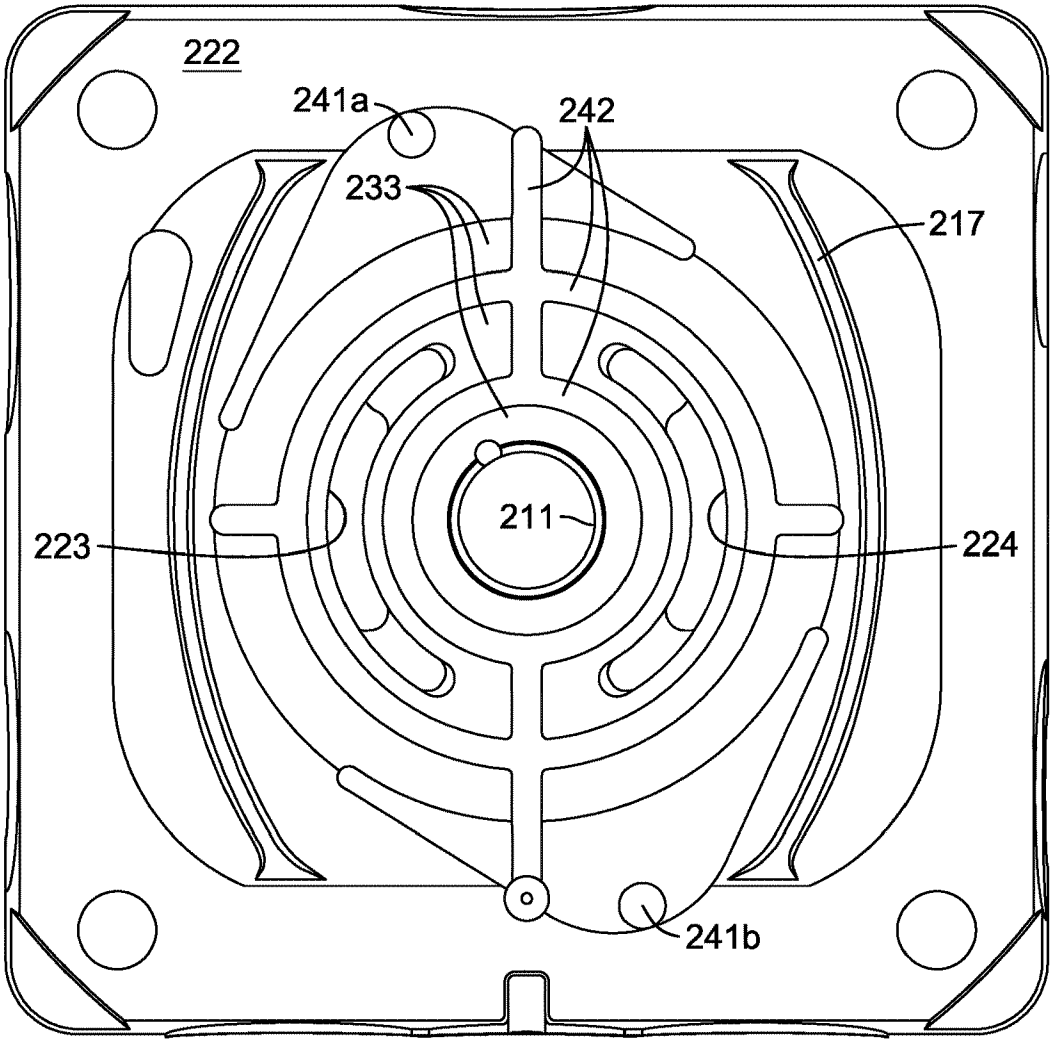
FIG. 6 is a plan view of a second end cap for a hydraulic drive unit, adapted to receive a valve plate formed in accordance with one or more of the principles disclosed herein.

While FIGS. 1-4 depict a running surface 113 that is integrally formed on a pump end cap 122, it can be seen from FIGS. 9-11 that a similar running surface 413 could be formed on center section 421 on which both pump cylinder block 408 and a motor cylinder block (not shown) are disposed. Other similar structure for rotatably mounting a cylinder block could be used. In addition, a valve plate attached or disposed on an end cap, center section or other structure could also be used with the pressure gradient grooves depicted in FIG. 4 or 8 formed thereon. Such an embodiment is depicted in FIGS. 6 and 7, where valve plate 230 is mounted on a mounting surface 233 of end cap 222. Valve plate 230 provides a running surface 213 separate from end cap 222, along with a first pair of kidney ports 218 and 219 extending through valve plate 230 and communicating with a second pair of kidney ports 223 and 224 in end cap 222. Pressure gradient grooves 218*a* and 218*b* are provided for kidney port 218, while pressure gradient grooves 219*a* and 219*b* are provided for kidney port 219 in a manner similar to that described for the first embodiment. Reference groove 215 may also be machined in valve plate 230 in the same manner as, and for the same purpose as reference groove 115 in the first embodiment. Shaft support bore 211 is also provided in end cap 222 for the pump or input shaft, such as input shaft 401 or its equivalent. Stiffening ribs 217 may optionally be provided in this embodiment also. Valve plate 230 may be located on end cap 222 using pins 241*a* and 241*b* engaged to corresponding notches 231*a* and 231*b*. A plurality of pressure relief passages 242 may be formed on end cap 222 under valve plate 230 to help eliminate any tendency of valve plate 230 to lift off the surface of end cap 222 during operation.

While specific embodiments have been described in detail, it will be appreciated by those skilled in the art that various modifications and alternatives to those presented herein could be developed in light of the overall teachings of the disclosure. Accordingly, the particular arrangements disclosed are meant to be illustrative only and not limiting as to the scope of the invention which is to be given the full breadth of the appended claims and any equivalent thereof.

What is claimed is:

1. A hydraulic drive device, comprising:

a center section disposed in a housing;

a pump cylinder block engaged to and driven by a pump shaft, the pump cylinder block being rotatably disposed on a running surface disposed in the housing, the running surface comprising:

a first kidney port having a first leading end and a first trailing end;

a second kidney port having a second leading end and a second trailing end;

a first pressure gradient groove in fluid communication with the first leading end, the first pressure gradient groove having a first distal end;

a second pressure gradient groove in fluid communication with the first trailing end, the second pressure gradient groove having a second distal end;

a third pressure gradient groove in fluid communication with the second leading end, the third pressure gradient groove having a third distal end; and a fourth pressure gradient groove in fluid communication with the second trailing end, the fourth pressure gradient groove having a fourth distal end;

wherein the first and second kidney ports are disposed along a pitch circle passing substantially through a first center of the first kidney port and a second center of the second kidney port, the first and fourth distal ends overlap along a first arc of the pitch circle, and the second and third distal ends overlap along a second arc of the pitch circle.

2. The hydraulic drive device of claim 1, wherein the second distal end and the fourth distal end are disposed outside the pitch circle.

3. The hydraulic drive device of claim 1, wherein the first distal end and the third distal end are disposed inside the pitch circle.

4. The hydraulic drive device of claim 1, wherein, the fourth and second pressure gradient grooves are longer than the first and third pressure gradient grooves.

5. A hydraulic drive device, comprising:

a center section disposed in a housing;

a pump cylinder block engaged to and driven by a pump shaft, the pump cylinder block being rotatably disposed on a running surface disposed in the housing;

a first kidney port having a first leading end and a first trailing end;

a first pressure gradient groove having a first proximal end in fluid communication with the first leading end and a first distal end;

a second pressure gradient groove having a second proximal end in fluid communication with the first trailing end and a second distal end;

a second kidney port having a second leading end and a second trailing end;

a third pressure gradient groove having a third proximal end in fluid communication with the second leading end and a third distal end;

a fourth pressure gradient groove having a fourth proximal end in fluid communication with the second trailing end and a fourth distal end, wherein the first, second, third, and fourth distal ends each have a first depth from a face of the running surface;

a first generally flat ramp extending from the first distal end to the first proximal end, the first proximal end being deeper from the face than the first distal end;

a second generally flat ramp extending from the second distal end to the second proximal end, the second proximal end being deeper from the face than the second distal end;

a third generally flat ramp extending from the third distal end to the third proximal end, the third proximal end being deeper from the face than the third distal end; and a fourth generally flat ramp extending from the fourth distal end to the fourth proximal end, the fourth proximal end being deeper from the face than the fourth distal end;

wherein, the first proximal end is deeper from the face than the second proximal end, and the third proximal end is deeper from the face than the fourth proximal end.

6. The hydraulic drive device of claim 5, wherein the first and second kidney ports define a pitch circle passing substantially through a first center of the first kidney port and a second center of the second kidney port.

7. The hydraulic drive device of claim 6, wherein the second distal end and the fourth distal end are disposed outside the pitch circle.

8. The hydraulic drive device of claim 6, wherein the first distal end and the third distal end are disposed inside the pitch circle.

9. The hydraulic drive device of claim 6, wherein the first and fourth distal ends overlap along a first arc of the pitch circle.

10. The hydraulic drive device of claim 9, the second and third distal ends overlap along a second arc of the pitch circle.

11. The hydraulic drive device of claim 5, wherein at least one of the first, second, third, and fourth proximal ends is respectively joined to the first and second kidney ports via a radius.

12. A hydraulic drive device, comprising:

a center section disposed in a housing;

a pump cylinder block engaged to and driven by a pump shaft, the pump cylinder block being rotatably disposed on a running surface disposed in the housing;

a first kidney port and a second kidney port formed on the running surface;

a first leading pressure gradient groove having a first leading proximal end engaged to a first end of the first kidney port and a first leading distal end;

a first trailing pressure gradient groove having a first trailing proximal end engaged to a second end of the first kidney port and a first trailing distal end; and a second leading pressure gradient groove having a second leading proximal end engaged to a first end of the second kidney port and a second leading distal end;

a second trailing pressure gradient groove having a second trailing proximal end engaged to a second end of the second kidney port and a second trailing distal end;

wherein:

the first and second kidney ports are generally arcuate and define a pitch circle passing substantially through a first center of the first kidney port and a second center of the second kidney port;

the first trailing distal end is disposed outside the pitch circle; and the first leading distal end is disposed inside the pitch circle.

13. The hydraulic drive device of claim 12, wherein the second trailing distal end is disposed outside the pitch circle, and the second leading distal end is disposed inside the pitch circle.

14. The hydraulic drive device of claim 13, wherein the running surface is formed on the center section.

15. The hydraulic drive device of claim 13, wherein the first leading proximal end, the first trailing proximal end, the second leading proximal end and the second trailing proximal end are all disposed on the pitch circle.

16. The hydraulic drive device of claim 13, wherein the first and second leading pressure gradient grooves respectively overlap the first and second trailing pressure gradient grooves.

17. The hydraulic drive device of claim 16, wherein the first leading proximal end, the first trailing proximal end, the second leading proximal end and the second trailing proximal end are all disposed on the pitch circle.

18. The hydraulic drive device of claim 1, wherein the running surface is formed on the center section.

19. The hydraulic drive device of claim 5, wherein the running surface is formed on the center section.

* * * * *